United States Patent [19]

Ting

[11] Patent Number: 4,685,263

[45] Date of Patent: Aug. 11, 1987

[54] ALUMINUM PLATE CURTAIN WALL STRUCTURE

[76] Inventor: Raymond M. L. Ting, 318 Holiday Dr., Pittsburgh, Pa. 15237

[21] Appl. No.: 866,271

[22] Filed: May 23, 1986

[51] Int. Cl.[4] ..... E04H 1/00

[52] U.S. Cl. ..... 52/235; 52/303; 52/533; 52/544; 52/511

[58] Field of Search ..... 52/533, 544, 547, 531, 52/539, 235, 511, 508, 546, 573, 303

[56] References Cited

U.S. PATENT DOCUMENTS

| | | | |
|---|---|---|---|
| 2,960,195 | 11/1960 | Toth | 52/235 |
| 3,672,107 | 6/1972 | Santry | 52/235 |
| 4,257,204 | 3/1981 | Rieger | 52/539 |
| 4,319,437 | 3/1982 | Murphy | 52/530 |
| 4,463,533 | 8/1984 | Mullet | 52/539 |
| 4,483,122 | 11/1984 | Crandell | 52/235 |
| 4,546,582 | 10/1985 | Gartner | 52/235 |
| 4,571,905 | 2/1986 | Kaminaga | 52/235 |

FOREIGN PATENT DOCUMENTS

| | | | |
|---|---|---|---|
| 691097 | 7/1964 | Canada | 52/235 |
| 2154004 | 5/1973 | Fed. Rep. of Germany | 52/539 |
| 2102470 | 2/1983 | United Kingdom | 52/235 |
| 2127058 | 4/1984 | United Kingdom | 52/235 |

*Primary Examiner*—Henry E. Raduazo

*Attorney, Agent, or Firm*—William J. Ruano

[57] ABSTRACT

This invention relates to a metal plate curtain wall structure. The joints of the metal plate structure are sealed weathertight without exposed caulking. A second line defense against water infiltration is formed by a concealed internal drainage system without exposed weep holes eliminating the water stain problem under the weep holes and enhancing the architectural appearance.

A plate connection system securely fastened to the structural support is slidable in the direction parallel to the plate surface allowing free thermal expansion of the plate without weakening the resistance against wind load acting normal to the plate surface. The connection system is also designed to absorb any conceivable dimensional tolerance of the support frame facilitating the easiness of field erection.

12 Claims, 12 Drawing Figures

ALUMINUM PLATE CURTAIN WALL STRUCTURE

This invention relates to an aluminum plate curtain wall structure.

BACKGROUND OF THE INVENTION

1. Field of the Invention

This invention relates to building wall structures and, more particularly, to dry sealed, flat metal plate exterior wall panel systems used in curtain wall construction. The metal plate is most commonly made of painted aluminum but can be made of painted steel or stainless steel.

2. Description of the Prior Art

Aluminum wall plate panels have been widely used in curtain wall construction. There are two major categories of the metal plate curtain wall systems; namely, a wet sealed system, and a dry sealed syetem. In the wet sealed system, exposed caulking is applied along the vertical and horizontal joints between panels to form a weather-tight exterior wall surface. In the dry sealed system, it is required that practically all sealants, such as gaskets or sealants, be concealed from exterior viewing except smll areas, such as the spliced joint or four corner intersection. Only the prior art dry sealed system which relates to the present invention will be discussed below.

The individual plate panel consists of an exterior flat metal plate and four perimeter members structurally connected to the plate using structural adhesive, connecting clips, welded studs, or the combinations thereof. The thickness of the metal plate normally ranges from 0.06 inches (1.524 mm) to 0.25 inches (6.35 mm). The width of the plate normally ranges from 1 foot (0.3048 m) to 5 feet (1.524 m). The length of the plate normally ranges from 3 feet (0.9144 m) to 20 feet (6.069 m). The perimeter members are normally made of extruded aluminum. Depending on the design wind load intensity and the plate size, intermediate plate stiffening members may be required. At least one of the perimeter members is securely fastened to the wall panel supports. Under wind load condition, the load on the wall panel surface is transmitted to the perimeter members into the wall supports.

In addition to the load resisting requirement, the performance requirements of a dry sealed flat metal plate exterior wall panel system include the following items:

a. To retain the flat appearance of the plate, the plate shall be designed to move relatively free in relation to the perimeter members in the case of thermal expansion or contraction. To accomplish this goal, several methods have been used to connect the plate to the perimeter members, such as using flexible structural adhesive (e.g.—silicone), slidable clips, welded studs on the plate with an oversized hole on the perimeter member, or the combination thereof.

b. To prevent panel bowing under therml expansion condition, the perimeter member shall be designed to move relatively free in relation to the wall supports. To accomplish this goal, elongated holes on the connecting member are normally provided around the fasteners, such as metal screws or bolts. The problem caused by the elongated holes is due to the following two conflicting functional requirements. For resisting the wind load normal to the wall surface, it is desirable to install the fasteners as tight as possible, while for allowance of thermal movements, it is desirable to install the fasteners as loose as possible. Weighing the two functional requiremnts, it is difficult, if not impossible, to have an optimal field control in installing the fasteners. In addition, prepunching the elongated holes in the shop will severly limit the ability to absorb the erection tolerance in the field concerning the location and alignment of the wall supports, while making the elongated holes in the field is time consuming and difficult.

c. To limit the air and water infiltration, the panel joints must be sealed in a concealed location. Shop applied perimeter sealant using either caulking or gasket has been utilized to seal off the gap between the plate and the perimeter members. To accomplish the goal of concealed sealant, the panel joints are formed by engaging a male spline into a female groove, whereby the sealant is hidden within the female groove and the exposed part of the male spline becomes the exposed panel joint surface. The male spline is normally served as a structural component to transfer the load from the female side perimeter member into the male side perimeter member. The male spline is normlly either an integral part of the perimeter member or securely fastened to the perimeter member. Panels are engaged both horizontally and vertically in the same manner. The problems with the construction includes the following items:

1. The erection can be performed in a single direction only, either from left to right, or from right to left.
2. It is difficult to erect a bent corner panel.
3. If the wall surface is wrapped around a building, it is difficult to install the last panel around each course.
4. It is difficult, if not impossible, to replace an individual damged panel after the completion of the wall construction.

d. The wall system must be designed to drain out the water due to backside condensation and possible leakage through the panel joints. To accomplish this goal, an internal horizontal gutter is built in the top perimeter member to collect the condensation and leakage water for drainage toward outside. The gutters are spliced across the vertical panel joints to make them continuous. Two methods of gutter drainage have been known in the art. The first method is to provide exposed weep holes near the bottom of the gutter. The second method is to provide internal vertical drainage channels to allow the water to drain from the top gutter to the gutter below and eventually to the bottom gutter at the wall base or window head where exposed weep holes are provided to drain the water to the exterior. The problems with the first method include the following items: (1) Under a positive pressure difference (i.e., exterior pressure being greater than the interior pressure), the water will continue to flow into the internal gutter through the weep holes until the water head in the gutter is adequate to counterbalance the pressure difference. Therefore, no matter whether the panel joints leak or not, a significant amount of water will be accumulated in the internal gutter. Thus, the first defense against the water leakage is solely relied on the integrity of the gutter spliced joint and the use of the internal gutter system as a second line of defense against water leakage becomes a pure illusion only; (2) When air penetrates through the weep holes, it creates a bubbling phenomenon in the water within the gutter and causes the water to splash over the gutter leg producing the uncontrolled water leakage condition. To prevent the water splashing problem, normally porous baffle material is installed at the weep hole location. However, when the baffle is totally submerged in the water, it becomes ineffective. The alternative is to use a higher gutter leg or a separate shielding plate which increases the cost of the system; (3) The exposed weep holes are unsightly and may create water stains on the wall surface under the weep holes; (4) The workmanship of the field-installed gutter spliced joint is critical to the successful function of the design. The problems with the second method of gutter drainage include the following items: (1) The water due to condensation and possible joint leakage is accumulated at the bottom gutter for drainage. For a high wall construction, the volume of expected water at the bottom is difficult to calculate and thus, is difficult to design for proper drainage; (2) The required gutter capacity varies from level to level. Using the maximum required gutter capacity for the design of the top perimeter member is uneconomical. Using different design for different level is costly and ipractical for mass production.

SUMMARY OF THE INVENTION

The objective of this invention is to provide a dry sealed flat metal plate exterior wall panel system to achieve the following functional objectives:

1. An internal drainage system with concealed weep holes which do not allow the penetration of the exterior water into the internal gutter while allowing gutter water due to back side condensation and possible joint leakage, to drain out at each level of the horizontal panel joint, i.e., a true second defense against water infiltration.

2. A panel connection system which positively anchors the panel to the wall, supports against wind loading while allowing free thermal movement of the perimeter member in relation to the wall support and which also can absorb maximum erection tolerances concerning the location and alignment of the wall supports.

3. A vertical joint revealing metal surface which is continuous over the panel horizontal joints except at the spliced joint where allowance for thermal movement is required.

4. A vertically slidable vertical panel joint design which allows the replacement of an individual panel in an upward fashion without disturbing the panel below or the panels on the sides.

5. A vertical panel joint design which allows mximum erection flexibility in the erecting procedure including bay-to-bay upward erection, course-by-course erection, left-to-right or right-to-left erection and which also allows easy installation of a bent corner panel or the last panel in each course of a wrapped-around-the-building wall surface.

6. An internal gutter system without spliced joints over the vertical panel joint which allows maximum flexibility in architectural panel layout design, such as stepwise or staggered horizontal panel joints.

A curtain wall structure of the present invention consists of a number of aluminum plate panels interlocked both vertically and horizontally to form a weather-tight exterior wall surface. The aluminum plate panel consists of an exterior aluminum plate and four perimeter aluminum extrusion members structurally connected to the plate using structural adhesive, connecting clips, welded studs, or the combinations thereof. Continuous perimeter seal is provided between the plate and the perimeter extrusion using proper sealants such as caulking or gaskets. Connecting means to the wall supporting members are provided at the top extrusion to take the dead weight of the panel and to resist the reaction force due to wind load. The horizontal and vertical panel joints are formed by the engagement of a male spline into a female groove and sealed by concealed sealant such as caulking gasket within the female groove. The female groove is an integral part of the perimeter extrusion. The male spline can be either an integral part of the perimeter extrusion or an independent piece.

Allowance for therml movement is provided in the panel joint, the connecting means, or the combination thereof. To allow thermal movement of the plate to be independent of the perimeter extrusion, oversized holes are provided in the case of clip connection. To allow thermal movement to be absorbed between panels, the depth of the female groove is larger than the male spline penetration. To allow thermal movement of the perimeter extrusion to be independent of the wall supporting members, the connecting clip is provided with a keyway slot which receives a key rib in the top extrusion.

DESCRIPTION OF THE PREFERRED EMBODIMENTS

Figure 1:
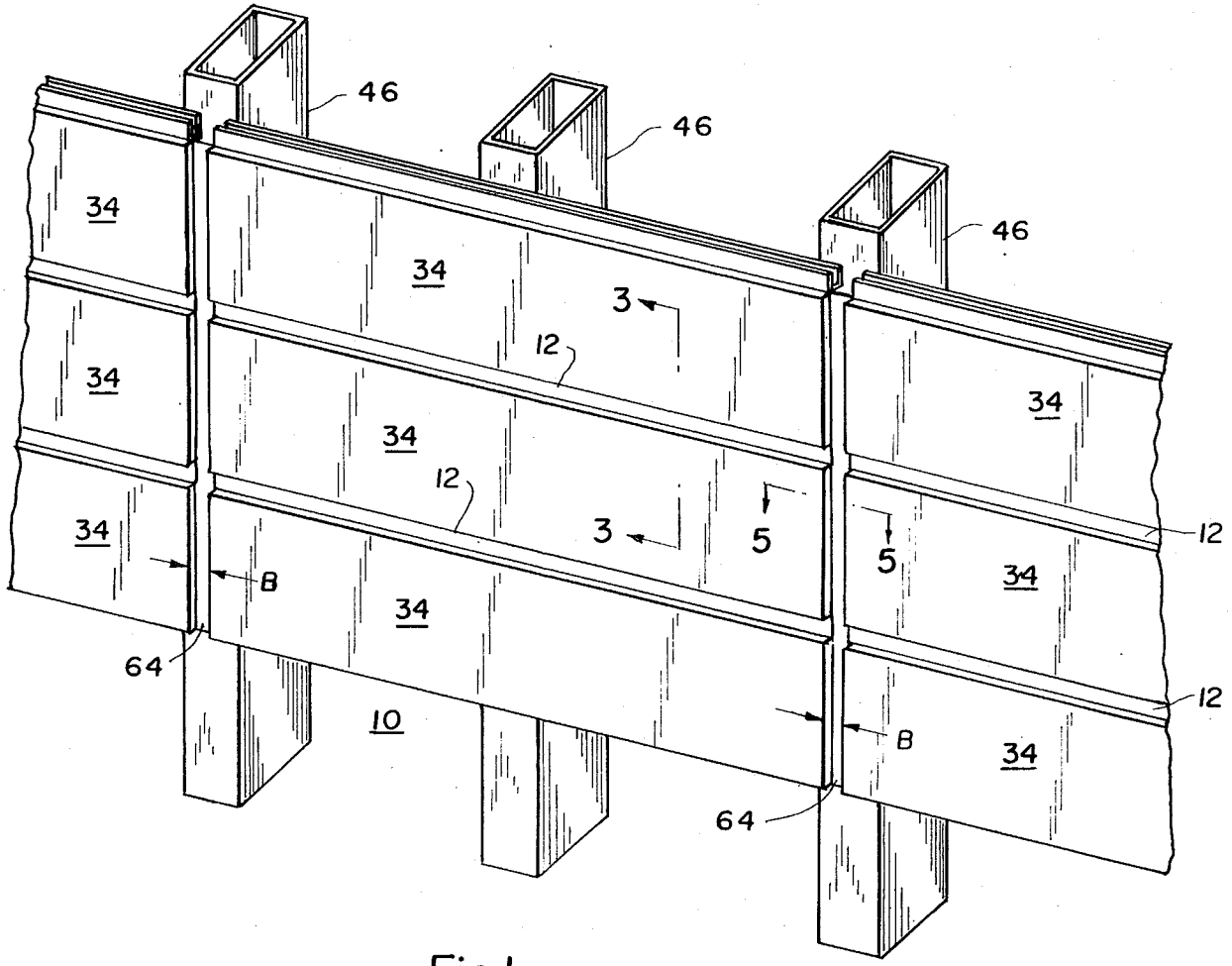
FIG. 1 is an isometric view illustrating a portion of the assembled wall structure of this invention erected in the horizontal mode vertical mullion supports.

FIG. 1 illustrates a wall structure 10 of this invention erected in the horizontal mode supported by vertical mullions 46. The horizontal reveal joints 12 are formed between vertically spaced-apart panels 34. The vertical reveal joints 64 having a spacing B are formed between horizontally spacedapart panels 34.

Figure 2:
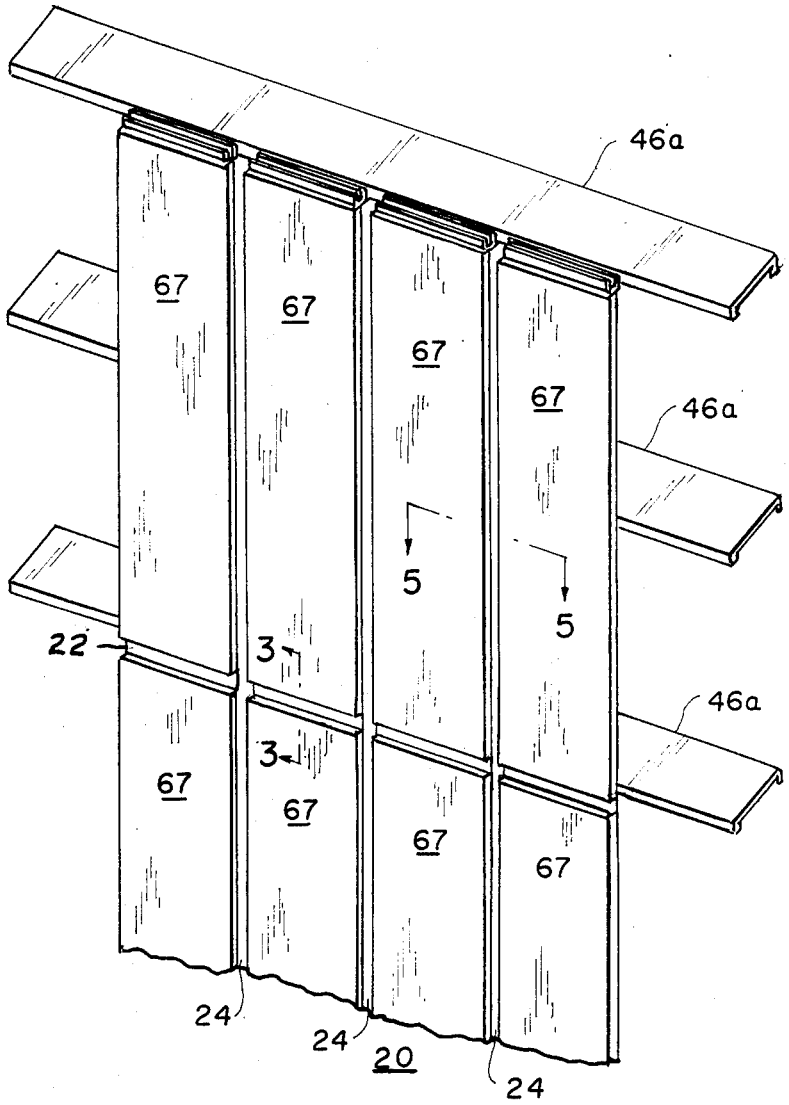
FIG. 2 is an isometric view illustrating a portion of the assembled wall structure of this invention erected in the vertical mode with horizontal girt supports.

FIG. 2 illustrates a wall structure 20 of this invention erected in the vertical mode supported by horizontal girts 46*a*. The horizontal reveal joint 22 is formed between vertically spaced-apart panels 67. The vertical reveal joints 24 are formed between horizontally spaced-apart panels 67.

Figure 3:
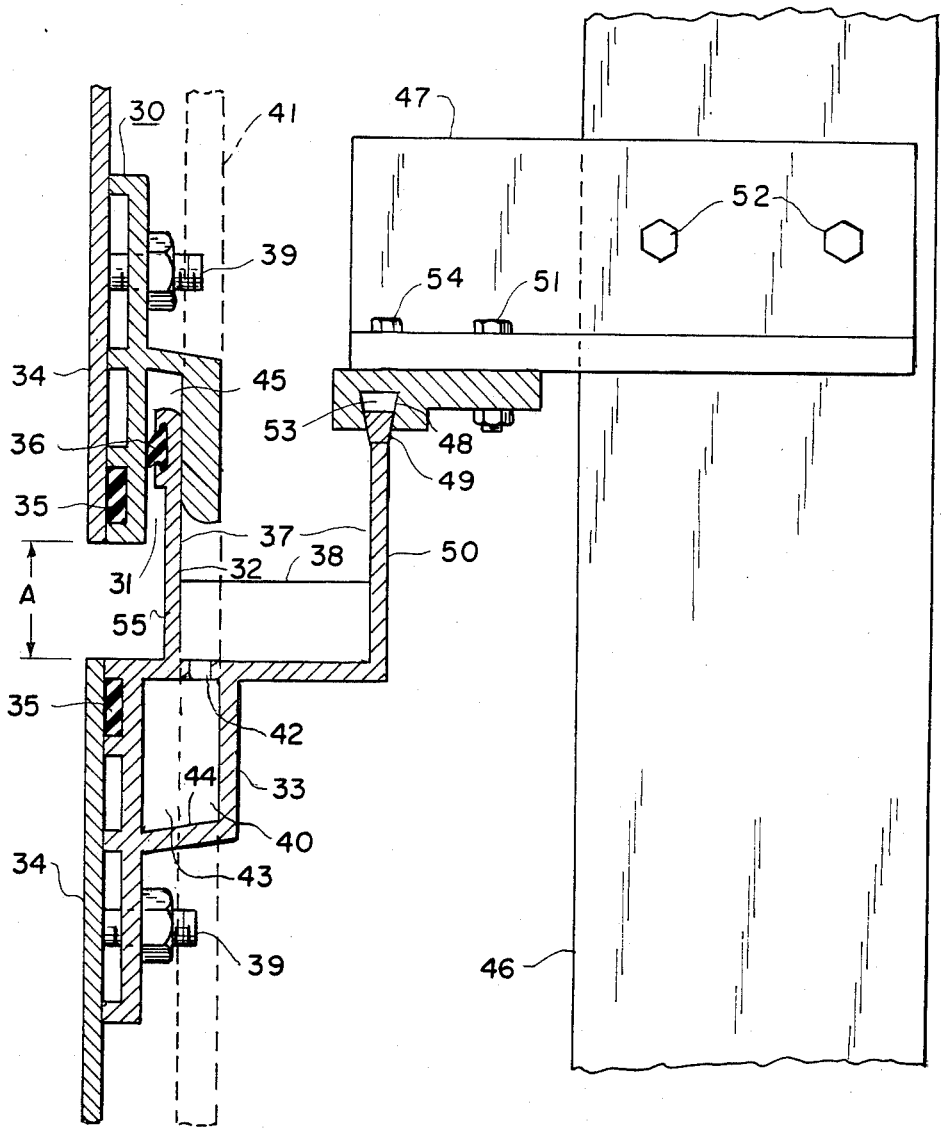
FIG. 3 is a typical vertical fragmentary cross-sectional view taken along line 3—3 of FIG. 1 or FIG. 2 of the horizontal joint between panels of this invention.
Figure 4:
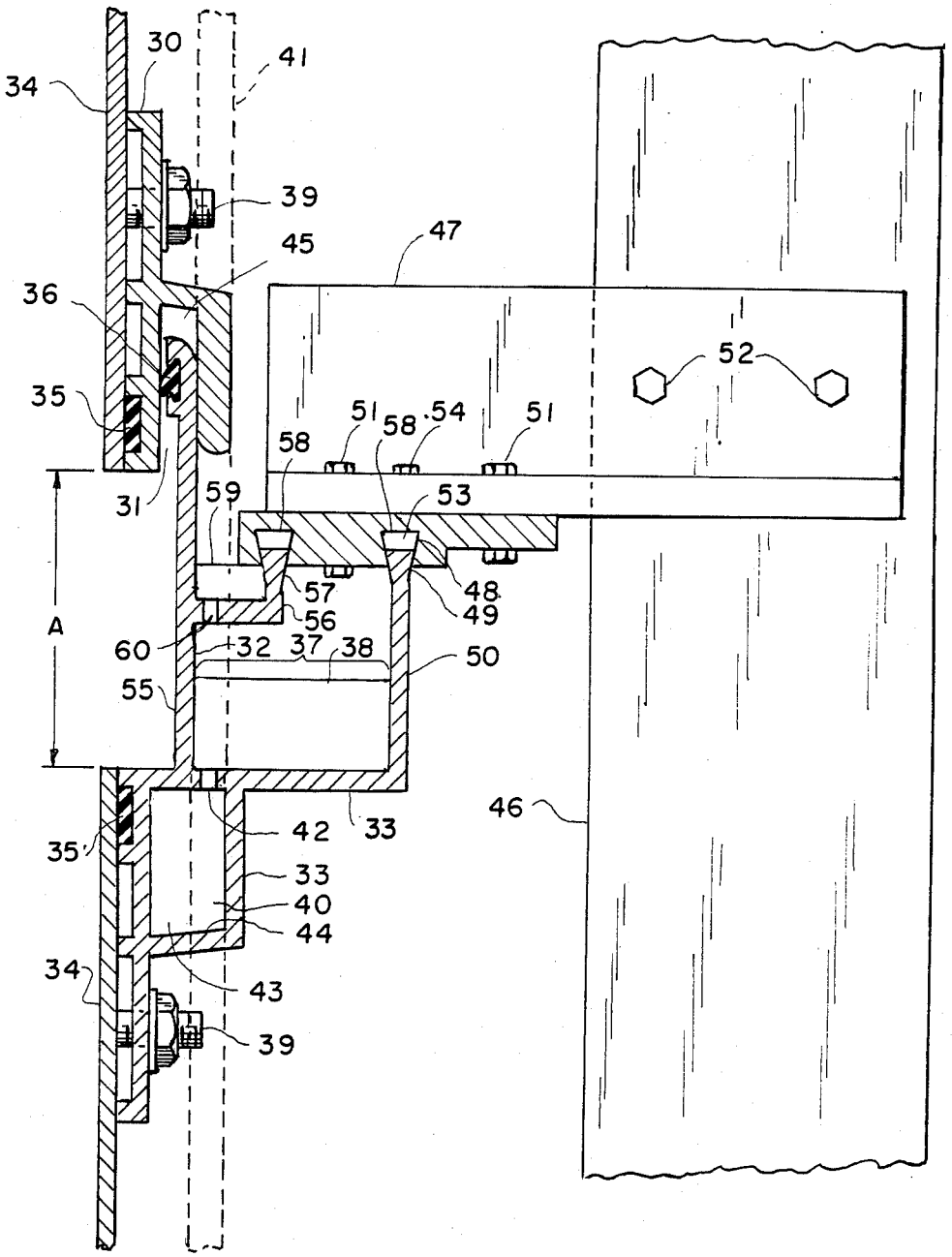
FIGS. 4 and 4*a* are other typical vertical, fragmentary cross-sectional views showing modification of FIG. 3 of a horizontal joint between panels of this invention.
Figure 4A:
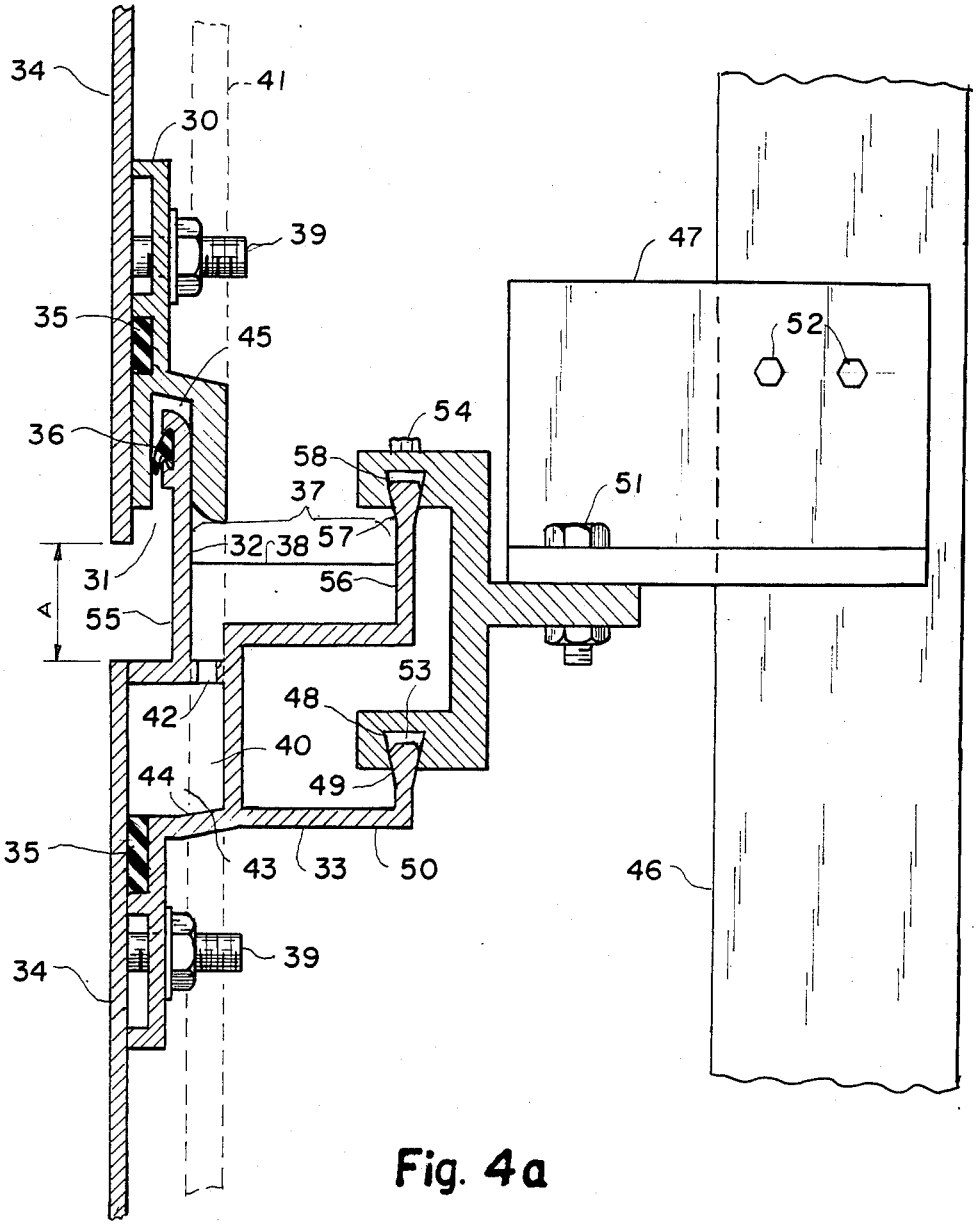

FIGS. 3, 4, and 4*a* show three different typical fragmentary, vertical cross-sections of horizontal panel joints taken along line 3—3 of FIG. 1 or FIG. 2 of this invention. The bottom perimeter extrusion 30 of the panel, shown above, has a female groove 31 which is engaged with the male spline 32 of the top extrusion 33 of the panel, as shown below, resulting in a horizontal reveal joint 55 having a width of reveal of "A" dimension. The perimeters between the exterior plates 34 and the extrusions 30,33 are sealed by sealants 35. The horizontal joint is sealed by the gasket 36 which is concealed in the female groove 31. There is an internal gutter 37 in the top extrusion 33 with end dams 38 located near the ends of the panel. The exterior plates 34 are structurally connected to the extrusions 30 and 33 using spaced-apart welded studs 39.

There is an enclosed hollow space 40 beneath the internal gutter 37 and miter-matched with the vertical side perimeter members which are not shown. Shown by dotted lines is the location of the vertical reveal joint spline 41 at each end of the anel. At least one weep hole 42 is provided at the bottom of the gutter 37 and penetrated into the hollow space 40. The weep hole is located at a sufficient distance away from the vertical joint, preferably a minimum of six inches (152 m), to prevent the exterior water from flowing into the gutter 37 through the weep hole 42 under a positive pressure (i. 3., exterior pressure being greater than interior pressure) condition. As it can be seen from the relative locations of the splines 32 and 41, a concealed opening 43 directed to the outside is formed at each end of the vertical joint location. The water due to back side condensation and horizontal joint leakage will be collected in the internal gutter 37 and then will drain into the hollow space 40 and then will drain to the outside at the vertical joint location through the end opening 43. To help the drainage, it is preferred to have a slight slope toward the exterior at the bottom 44 of the hollow space 40. Since the hollow space 40 is open to the outside, the pressure inside the hollow space 40 is equalized with the exterior environment and thus water will not build up in the hollow space under positive pressure condition. In addition, the weep hole is concealed behind the exterior wall surface and shielded from direct exterior water infiltration; thus, the internal drainage system is used to drain the water due to back side condensation and horizontal joint leakage only; i.e., a true second defense in the protection against water infiltration.

The void 45 in the horizontal joint is provided to absorb panel fabrication tolerance and thermal movements of the top panel. The panel is structurally connected to the wall support 46 using at least two composite clip assemblies 47 (see FIG. 9) having a keyway 48 which is designed to engage with a key rib 49 at the top extrusion 33.

The clip assembly consists of two pieces fastened together at location 51 using screws, bolts, or rivets. The clip assemblies 47 are slid into engagement with the key rib 49 from the panel end to the support location and fastened to the support 46 using at least two spaced-apart fasteners 52. To facilitate the easiness of sliding the clip assembly 47 to the support location, it is desirable to have a small gap 53 between the clip assembly 47 and the top of the key rib 49. As it can be seen that adequate clearance will be formed when the closed end of the keyway 48 is in contact with the top of the key rib 49. The composite clip assembly 47 is especially useful for connection to a support surface perpendicular to the wall plate surface as explained below. Before the installation of the fasteners 52, the clip assembly 47 can be freely moved horizontally along the key rib 49 and inwardly or outwardly along the support surface of the support member 46. In this manner, the connection system can easily absorb any cnceivable shop or erection tolerances of the support member 46. Fasteners 51 and 52 will be tight and fixed to resist the reaction force due to wind loading while allowing free horizontal thermal movement of the panel in relation to the support 46 in the direction parallel to the wall surface. In order to prevent walking of the panel horizontally, one of the connecting clips 47 must be secured to the key rib 49 using a pin or fastener at location 54 to create a fixed point. For a long panel, it is desirable to create the fixed point at the clip nearest to the midpoint along the length of the panel so that the thermal movements to both panel ends will be more or less balanced.

The spline 32 has the following three functions: (1) to seal the horizontal joint; (2) to form the reveal horizontal joint surface 55; and (3) to support the bottom extrusion of the panel above in resisting the wind loading. Depending on the architectural requirement, the width of the reveal (i.e., dimension "A") may vary.

In case of a large reveal width as shown in FIG. 4, it is structurally more efficient to create one intermediate spline upport 56 which is connected to the connecting clip assembly 47 by a second set of key rib 57 and keyway 58 arrangement. In this manner, an upper gutter is formed and the corresponding gutter end dams 59 and weep hole 60 are provided.

FIG. 4*a* shows a similar structure to FIG. 3 with a different configuration of extrusions and gutters and with second set of key rib 57 and keyway 58 arrangement for high load application.

Figure 5:
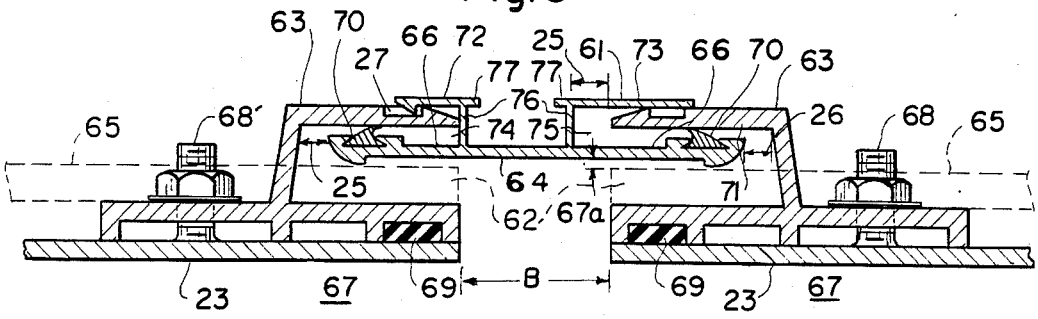
FIG. 5 is a typical horizontal, fragmentary cross-sectional view taken along line 5—5 of FIG. 1 or FIG. 2 of the vertical joint for panels erected in the horizontal or vertical mode of this invention.

FIG. 5 shows the horizontal cross-section of a typical vertical joint of the wall structure of this invention taken along line 5—5 of FIG. 1 or FIG. 2. The vertical joint is formed by engaging an independent vertical joint spline extrusion 61 into the grooves 62 of the vertical perimeter extrusions 63 on both sides. In the horizontal panel application, the majority of the wind loading is directly carried through the top perimeter extrusion into the support, therefore, no additional structural support for the vertical perimeter extrusions 63 is required. Thus, the vertical reveal joint extrusion 61 is utilized mainly to form the vertical reveal joint surface 64 and to seal off the vertical joint with little structural requirement. The width of the grooves 62 is designed to contain both the horizontal joint spline 65, shown by dotted lines, and the vertical reveal joint spline 66. The front side of the vertical reveal extrusion 61 is in contact with the back side of the horizontal reveal spline 65 at the corners. A slight depression 67*a* of the exterior face of the order of 0.03 inches (9.76 mm) to 0.05 inches (1.27 mm) in the central portion of the exterior surface 64 of the vertical reveal extrusion 61 is provided to prevent coating damage due to relative movements between the vertical and the horizontal splines.

Similar to the top and bottom perimeter extrusions, as explained in FIGS. 3 and 4, the vertical perimeter extrusions 63 are structurally secured to the exterior plates 23 using spaced apart welded studs 68 and sealed by perimeter sealant 69. The vertical joint is sealed by gaskets 70 along the inner surface 71 of the vertical side grooves 62. A sealing pressure on the gaskets 70 is maintained at the locations where the vertical spline intersects the horizontal spline. Back flanges 72 and 73 are also provided on the vertical spline extrusion 61 to maintain a sealing pressure on the gaskets 70 between the vertically spaced-apart horizontal splines 65. The cavities 74 and 75 serve to contain the possible leakage water through the vertical joint and to allow the water to flow downwardly to the wall base for drainage toward the outside. The right side back flange 72 of the vertical joint extrusion 61 has a snap-in device 27 to secure the vertical spline in position. Clearances 25 and 26 are provided on the side pockets to absorb fabrication tolerances and relative thermal movements of panels across the vertical joint. For a small vertical reveal, dimension "B", the two legs 76 can be combined into one leg. Small tips 77 are provided on the legs 76 to help hold the sealant backer at the spliced joint.

Figure 6:
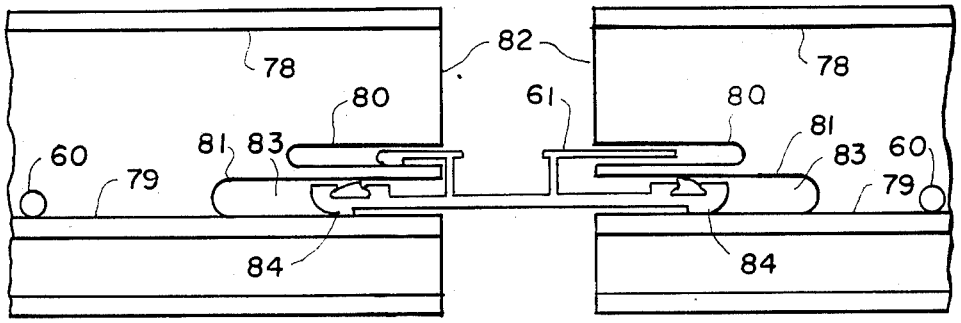
FIG. 6 is a typical top view of the vertical joint taken at the middle point of the horizontal reveal and looking downwardly.

FIG. 6 shows a typical top view of the vertical joint of this invention The bottom of the internal gutter 82 is shown between the back leg of gutter 78 and the horizontal spline 79 and has weep holes 60,60. To provide continuous vertical reveal extruson 61 over the horizontal joint, slots 80 and 81 must be cut into the bottom of the gutter 82. The slots 80 and 81 must have adequate clearance to absorb the relative panel thermal movements across the vertical joint. The voids 83 and the seams 84 between the vertical joint extrusion 61 and the horizontal spline 79 must be sealed during the erection.

Figure 7:
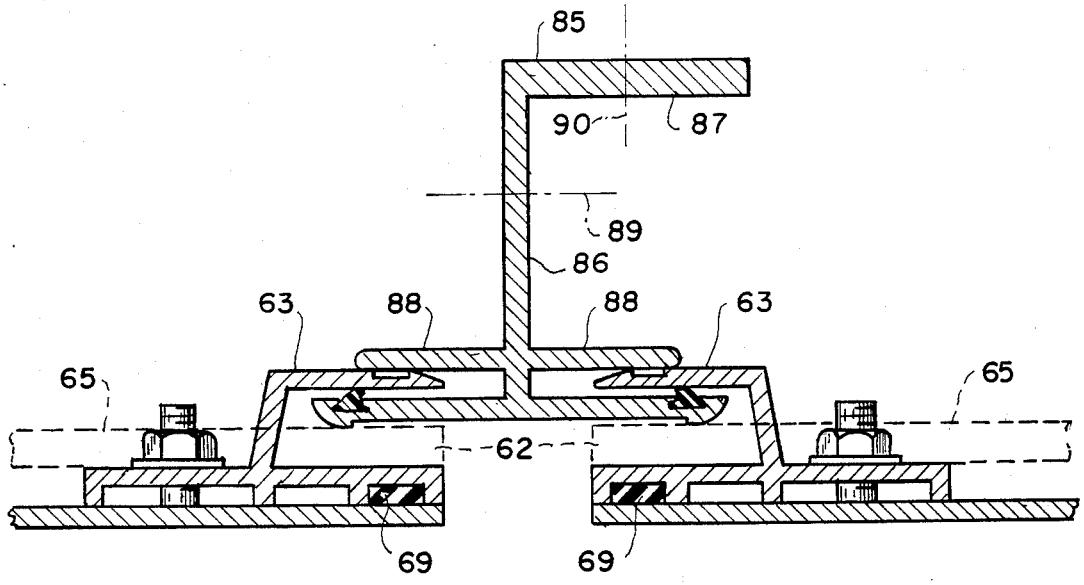
FIG. 7 is a typical horizontal cross-sectional view of a modification of FIG. 5 of the vertical joint for panels erected in the vertical mode of this invention.

FIG. 7 shows the horizontal cross-sectional view of a modification of FIG. 5, that is a typical vertical joint of the panel structure of this invention erected in the vertical mode. In the vertical applications, the majority of the wind loading is carried into the supports through the vertical perimeter extrusions and thus the panels must be anchored to the supports along the vertical joint. From the production point of view, it is desirable to use the same vertical extrusion regardless of the panel application (i.e., vertical or horizontal application). Therefore, it is more efficient to use th vertical reveal joint extrusion as the structural support for the vertical edges of the panel. Shown in FIG. 7, the engaging features of the vertical reveal joint extrusion 85 are similar to those explained in FIG. 5. The structural strength of the vertical joint extrusion 85 is provided by the additions of a web element 86 of sufficient depth and an interior flang 87 of sufficient cross-sectional area. The back flanges 88 of the spline is made strong enough to resist the reaction force from the vertical perimeter extrusions 63 and the snap-in feature is eliminated. The vertical joint extrusion 85 can be fastened through the web 86 into a support surface perpendicular to the wall surface at location 89 or through the interior flange 87 into a support surface parallel to the wall surface at location 90.

Figure 8:
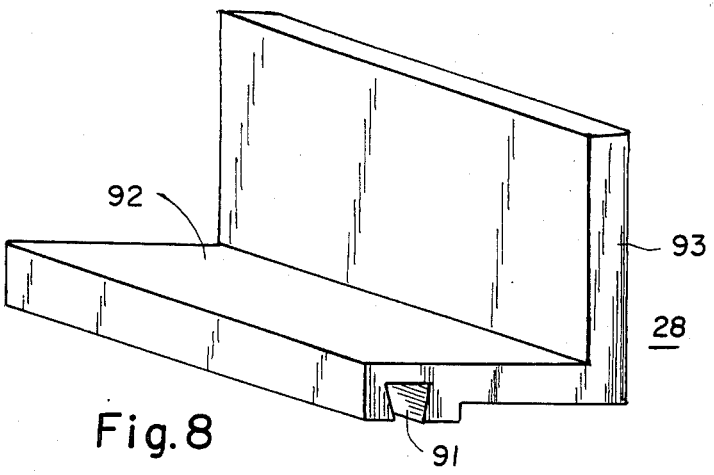
FIG. 8 is an isometric view of a simple connecting clip which is designed to be fastened to a support surface parallel to the wall surface.

FIG. 8 shows the isometric view of a typical simple connecting clip 28 of this invention. The keyway 91 is designed to fit with the key rib 49 as shown in FIG. 3. Depending on the design, multiple keyways can be provided. To fasten to the support, fasteners can penetrate through the horizontal leg 92 into a horizontal support surface or through the vertical leg 93 into a vertical support surface parallel to the wall surface. In both of the two fastening methods, shims my be required to absorb erection tolerances.

Figure 9:
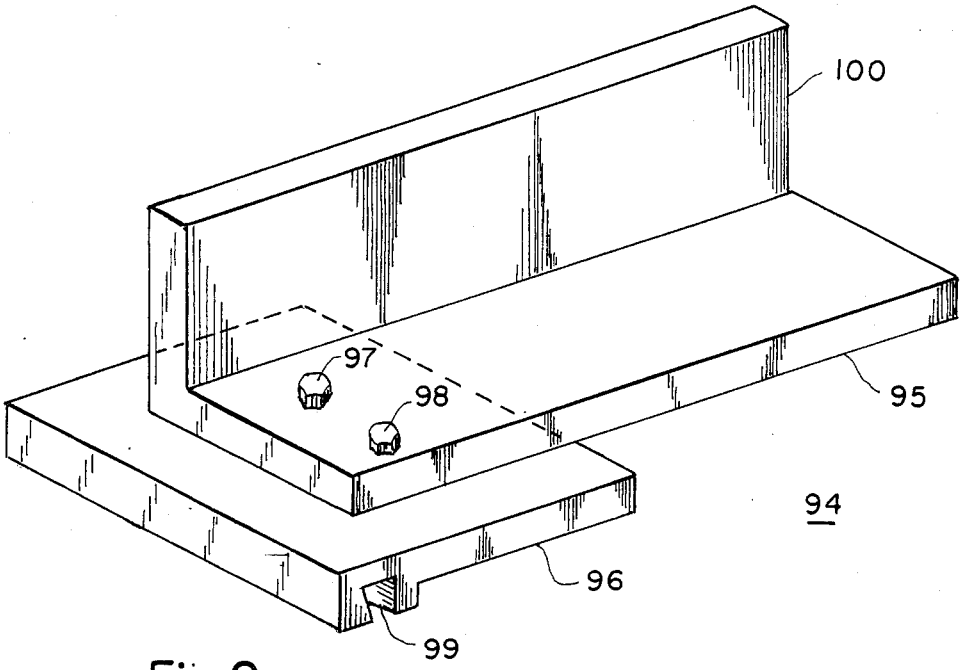
FIG. 9 is an isometric view of a composite connecting clip which is designed to be fastened to a support surface perpendicular to the wall surface.

FIG. 9 shows the isometric view of a typical composite connecting clip assembly of this invention. The clip assembly 94 consists of two separate clips 95 and 96 connected together by fasteners 97 and 98. The keyway 99 is designed to fit with the key rib 49 shown in FIG. 3. To absorb all possible tolerances, including support location and support member itself, one of the fasteners 97 and 98 can be shop applied to allow rotational adjustability and the other applied after the clip has ben fastened to the support. The up-and-down and in-and-out adjustability is accomplished when fasteners are used on the upstanding leg 100 into a vertical support surface perpendicular to the wall surface.

Figure 10:
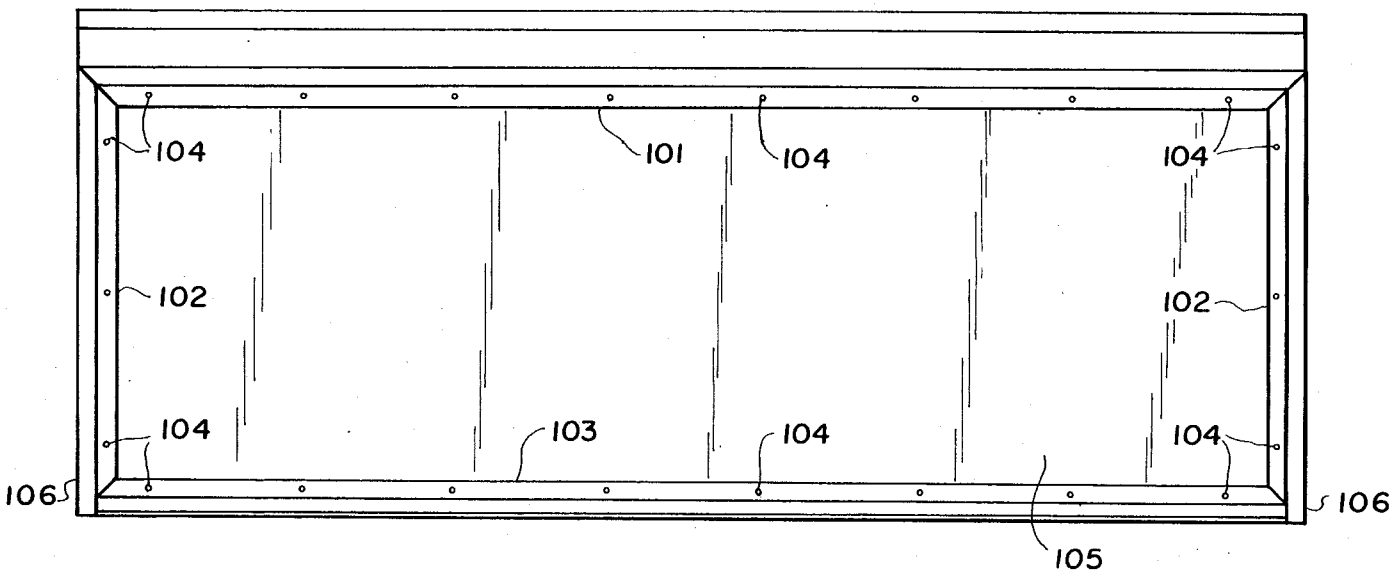
FIG. 10 is an elevational view of an assembled panel looking from the back side of the panel.

FIG. 10 shows the plan view of a typical assembled panel of this invention looking from the back side. The panel consists of one top perimeter extrusion 101, two identical vertical side extrusions 102, and one bottom perimeter extrusion 103. The perimeter extrusions, 101, 102, and 103 are connected to the front plate 105 using space-apart welded studs 104. The extrusions 101, 102, and 103 are miter-matched at the intersecting corners to allow continuous perimeter seals 35 (FIG. 3 and FIG. 4) and 69 (FIG. 5). As it is seen in FIG. 3 and FIG. 4, the width of the groove 31 in the bottom perimeter extrusion is designed to contain the horizontal joint spline 55 and seen in FIG. 5 and FIG. 7, the width of the groove 62 in the side extrusion 63 is designed to contain both the horizontal joint spline 65 and the vertical joint spline 66, to prevent the interference of the vertical spline penetration, the back flange of the side extrusions 102 is not miter-cut while the back flange of the bottom extrusion 103 is coped at the bottom corners 106.

Figure 11:
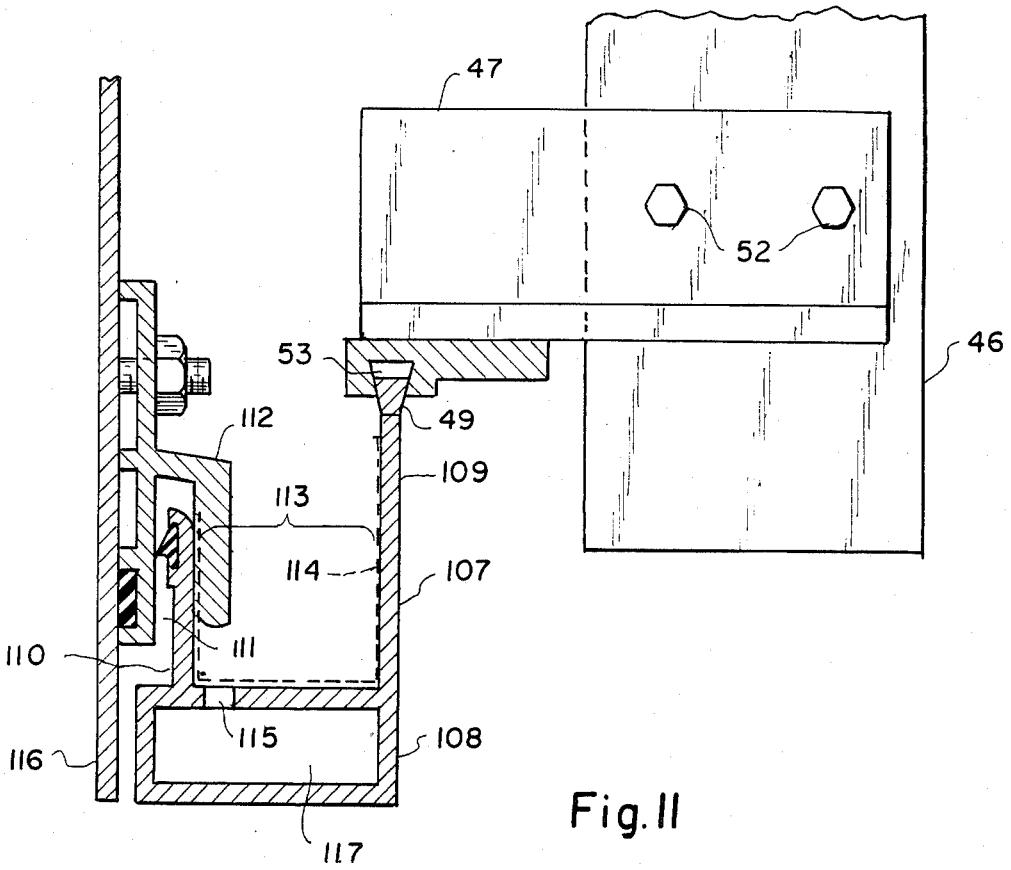
FIG. 11 is a vertical cross-section of a typical wall base structure of this invention.

FIG. 11 shows a vertical cross-section of a typical wall base structure of this invention. The base extrusion 107 consists of a bottom tube 108, a back gutter leg 109, and an upstanding spline 110 designed to be engaged into the groove 111 of the bottom extrusion 112 of the panel. The interior surface of the gutter 113 is spliced with a plate 114 (shown by dotted lines) and sealed over the spliced joint to make the gutter continuous. At least one drainage hole 115 away from the spliced joint is provided at the bottom of the gutter 113 to drain the water collected in the gutter 113 into the bottom tube 108. The total tube opening 117 is open to the outside at the spliced joint location to create a pressure equalization chamber allowing easy water drainage. The exterior wall plate 116 is extended downwardly to cover the front face of the base extrusion 107.

FIELD APPLIED SEALANT

The design of this invention is intended to seal off the exterior wall surface against water infiltration. Therefore, th following locations must be sealed during the erection.

1. The end openings of void 45 as shown in FIGS. 3, 4, and 4*a* at the vertical joint locations.
2. The seams 84 between the contacting surfaces of the vertical joint spline and the horizontal joint spline as shown in FIG. 6.
3. The voids 83 between the vertical joint spline and the bottom of gutter as shown in FIG. 6.
4. The spliced joint of the vertical joint spline.
5. The spliced joint of the wall base extrusion. Items 1 to 3 are concealed and thus they do not require special workmanship.

Even though Items 4 and 5 are exposed, they happen infrequently and occupy a tiny visual surface which will not disturb the overall appearance of the exterior wall surface.

GENERAL COMMENTS

The wall system of this invention provides a completely sealed exterior wall surface against water infiltration and an internal drainage system for draining water due to back side condensation and possible joint leakage. In the case of no condensation water and no joint leakage in a rain storm situation, the internal drainage system will remain completely dry; i e., a true second 1ine of defense against water infiltration. The internal drainage system consists of two components. The first component is an internal horizontal drainage system at each level of the horizontal panel joint to drain the water due to the plate back side condensation and possible horizontal joint leakage. The second component is an internal vertical drainage system at each vertical joint to drain the water due to possible vertical joint leakage by allowing the water to flow vertically to the wall base for final outward drainage. Since the second line of defense is utilized for safeguarding the imperfection of the first line of defense, it can be reasonably expected that the amount of water to be handled by the second line of defense is minimal. Therefore, the use of uninterrupted internal vertical drainage for high wall construction is feasible. The horizontal internal drainage and the vertical internal drainage are acting independently allowing total architectural freedom of arranging staggered or stepwide horizontal joint pattern. In addition, the architectural appearance is enhanced by the continuous vertical reveal joint running through the horizontal joints.

Due to the fact that the vertical reveal joint extrusion is erected independently, the advantages achieved include the following items:

1. A complete freedom in the erection procedure—panels can be erected bay-by-bay or course-by-course; left-to-right or right-to-left.

2. A complete freedom in locating the spliced joint of the vertical reveal joint extrusion. Vertical reveal joint extrusions of a stock length can be used for all design conditions with field cut for the last piece.

3. Easiness in panel engagement. To install a bent corner panel, it can be done easily by engaging the vertical spline and then lowering down to engage the horizontal joint. To install the last bay of a wrapped-around building, panels can be easily slid along the vertical splines on both sides into position.

4. Easines in panel replacement. To replace a panel, panels can be disassembled in an upward fashion by sliding vertically along the vertical splines on both sides without disturbing the panels below and on the sides.

The combination of keyway and key rib connection system allows positive anchoring of the panel against wind loading and free thermal movemnts of the panel.

While I have illustrated and described several embodiments of my invention, it will be understood that these are by way of illustration only and that various changes and modifications may be contemplated in my invention and within the scope of the following claims.

I claim:

1. A metal plate exterior wall structure comprising a number of individual panels securely fastened to a wall supporting frame system, both vertical and horizontal sealed reveal joints being formed between said panels, each individual panel including a front plate and a top perimeter member, two side perimeter members, and one bottom perimeter member, the perimeter members being structurally connected to the front plate and sealed thereto along their perimeters in between, the improvements comprising an internal horizontal gutter in said top perimeter member said top perimeter member having an enclosed hollow space with exterior end openings below said internal horizontal gutter, at least one hole at the bottom of the said internal horizontal gutter for leading condensate into the said enclosed hollow space.

2. A wall structure as recited in claim 1 together with dams at both ends of said internal horizontal gutter of said top perimeter member.

3. A wall structure as recited in claim 1 wherein said top perimeter member has a substantially U-shaped vertically upward extension forming said horizontal gutter.

4. A wall structure as recited in claim 3 wherein said extension has an outermost wall which forms a male spline, a female portion at the rear of said bottom perimeter member into which said male spline projects, and a perimetric seal between said outermost wall and said female portion.

5. A wall structure as recited in claim 1 wherein said panels extend horizontally in spaced relationship to form vertical joints and wherein said side perimeter members have rear female grooves in confronting relationship across each of said vertical joints, and a vertical joint spline member vertically slidably mounted in said female grooves to close off said vertical joint.

6. A wall structure as recited in claim 5 together with snap fitting interlocking means connecting said vertical joint spline member to said side perimeter members with means for sealing said vertical joint.

7. An individual panel as recited in claim 1 wherein the ends of said perimeter members are miter cut to meet and to form miter corners behind said front plate, and wherein each of said perimeter members contains a small pocket with sealant to form sealing lines between said front plate and said perimeter members, and wherein said sealing lines are engaged at said miter corners to provide a complete perimeter seal of said front plate.

8. A wall structure as recited in claim 1 wherein said panels extend vertically in spaced relationship to form horizontal joints and wherein said top perimeter member of said panel below said horizontal joint has an integral upstanding spline extending across said horizontal joint and adaptably engaged and sealed into a female groove of said bottom perimeter member of another said panel located above said horizontal joint.

9. A metal plate exterior wall structure comprising a number of individual panels securely fastened to a wall supporting frame system, each of the said panels having a front plate forming the exterior face of said wall structure, one top perimeter member, two side perimeter members and one bottom perimeter member; the improvement comprising at least one continuous horizontal key rib on said top perimeter member having an outwardly flared head portion and a connecting clip rigidly mounted on said wall supporting frame system and having at least one keyway corresponding in shape with said outwardly flared head portion and in which said continuous key rib is relatively slidable.

10. An individual panel as recited in claim 9 wherein a pair of said continuous horizontal key ribs are formed on said top perimeter member, running parallel to said exterior face of said wall structure, each having a horizontal bottom wall integral with said top perimeter member.

11. An individual panel as recited in claim 10 wherein each of said bottom walls has at least one weep hole for water drainage to a space below.

12. A metal plate exterior wall structure comprising a number of individual panels securely fastened to a wall supporting frame system, both vertical and horizontal sealed reveal joints being formed between said panels, each individual panel including a front plate and a top perimeter member, two side perimeter members, and one bottom perimeter member, the perimeter members being structurally connected to said front plate and sealed along their perimeters; the improvement comprising an internal horizontal gutter in said top perimeter member, said top perimeter member having a continuous channel below said internal horizontal gutter wherein an enclosed hollow space is formed between said front plate and said continuous channel, at least one hole at the bottom of said internal horizontal gutter for leading condensate into said enclosed hollow space.

* * * * *